United States Patent [19]

Oberley et al.

[11] Patent Number: 5,012,962

[45] Date of Patent: May 7, 1991

[54] INDEXING MECHANISM FOR A MANNEQUIN CARRIAGE HAVING A SLIDABLE, PIVOTABLE SUPPORT AND INDEX BAR MOVEABLE BY A FLUID CYLINDER FOR MOVEMENT BETWEEN A DRESSING POSITION AND A GARMENT PRESS

[75] Inventors: Gene Oberley, Cincinnati; Barbara Downie, Norwood, both of Ohio

[73] Assignee: American Laundry Machinery, Inc., Cincinnati, Ohio

[21] Appl. No.: 465,434

[22] Filed: Jan. 16, 1990

[51] Int. Cl.[5] ..... D06C 15/00; D06F 71/00; D06F 71/28

[52] U.S. Cl. ..... 223/57; 223/52; 38/7

[58] Field of Search ..... 38/7, 9, 2, 8, 42, 43; 223/57, 40, 51, 52, 60, 70, 72, 74, 76, 112; 104/106, 110, 118, 162; 68/5 R, 8; 8/149.3

[56] References Cited

U.S. PATENT DOCUMENTS

| | | | |
|---|---|---|---|
| 2,022,176 | 11/1935 | Baldwin | 223/57 |
| 2,241,373 | 5/1941 | Rawlinson et al. | 223/57 |
| 2,479,729 | 8/1949 | Davis | 223/57 |
| 2,481,399 | 9/1949 | Davis | 223/57 |
| 2,743,854 | 5/1956 | Strike | 223/57 |
| 2,757,832 | 8/1956 | Johnson et al. | 223/57 |
| 2,966,288 | 12/1960 | Nancarrow | 223/57 |
| 3,063,606 | 11/1962 | Davis | 223/57 |
| 3,070,268 | 12/1962 | Carpenter | 223/57 |
| 3,198,407 | 8/1965 | Hughes | 223/57 |
| 3,384,347 | 5/1968 | Lornitzo | 223/57 |
| 3,463,367 | 8/1969 | Campbell | 223/57 |
| 3,503,545 | 3/1970 | McMillan | 223/57 |
| 3,950,952 | 4/1976 | Krings | 104/118 |

FOREIGN PATENT DOCUMENTS

| | | | |
|---|---|---|---|
| 3205234 | 8/1983 | Fed. Rep. of Germany | 223/57 |
| 1399566 | 4/1965 | France | 223/57 |

*Primary Examiner*—Werner H. Schroeder
*Assistant Examiner*—Ismael Izaguirre
*Attorney, Agent, or Firm*—Bacon & Thomas

[57] ABSTRACT

An indexing mechanism for use in a garment pressing machine includes a support frame, a guide rail secured to the frame, a carriage supported by the guide rail for linear movement between dressing and pressing positions, and a fluid actuator for moving the carriage. The carriage carries a pressing buck or mannequin. The indexing mechanism includes an indexing bar having one end pivotally attached to the carriage for linear movement therewith and a second end slidably and pivotally mounted within a guide attached to the support frame. The actuator is connected between the support frame and a central portion of the indexing bar. Extension and retraction of the fluid cylinder causes the indexing bar to pivot and slide about one end within the guide space and to drive the carriage between its dressing and pressing positions at its other end. The other end of the guide bar attached to the carriage moves a greater distance than the actuator extension motion due to the motion amplification effect of the indexing bar.

7 Claims, 3 Drawing Sheets

INDEXING MECHANISM FOR A MANNEQUIN CARRIAGE HAVING A SLIDABLE, PIVOTABLE SUPPORT AND INDEX BAR MOVEABLE BY A FLUID CYLINDER FOR MOVEMENT BETWEEN A DRESSING POSITION AND A GARMENT PRESS

BACKGROUND OF THE INVENTION

This invention pertains to the art of laundry pressing systems having carriages which support a buck or mannequin and which are moveable between dressing and pressing positions. More particularly, the invention pertains to an indexing mechanism for moving and guiding the carriage between the dressing and pressing positions.

In such laundry pressing systems, the carriage is moved between its dressing and pressing positions a distance sufficient to assure that the operator stationed at the dressing position remains a safe distance away from the pressing position. It is known in the prior art to have such carriages mounted upon one or more guide rails and driven between the dressing and pressing positions by motor driven cables, chains, or fluid cylinders. This invention is directed to a fluid cylinder or actuator driven carriage arrangement.

In such prior art systems in which a carriage is moved between its dressing and pressing positions by a fluid cylinder or actuator, exceptionally long stroke cylinders have been required in order to drive the carriage between its dressing and pressing positions. Such long stroke cylinders generally require larger work areas, are more expensive to set up and operate due to the required stroke length of the cylinder, and are prone to malfunction due to bending stresses on the long piston rod of the cylinder.

It is the object of the present invention to accomplish the movement of the carriage between its dressing and pressing positions by use of a fluid actuator cylinder having a relatively short stroke. In order to accomplish this objective, a short stroke cylinder is used with a motion transfer guide linkage that produces an effective long travel of the buck or mannequin with a short piston stroke. Therefore, the arrangement in the present invention is capable of moving a carriage between a dressing position and a pressing position through a distance equal to that known in the prior art, but with a relatively short stroke cylinder and with very simple, inexpensive components.

BRIEF SUMMARY OF THE INVENTION

The present invention provides an indexing mechanism for moving a guided member, by use of an air or hydraulic cylinder, a distance greater than the stroke length of the cylinder. More particularly, the indexing mechanism is adapted for use in a laundry press in which the guided member is a carriage which supports a buck or mannequin. The carriage is moveable between a dressing position in which an operator would place a shirt or other garment on the buck or mannequin and a pressing position, located remote from the dressing operator, where the garment would be pressed by a suitable device moved against the buck.

As contemplated by the present invention, the indexing mechanism comprises a motion transfer linkage including a guide roller assembly including a pair of spaced guide rollers which define a guide space therebetween, an indexing bar having a first end pivotally secured to the carriage and a second end slidably mounted in the guide space. A telescopic fluid actuator cylinder is arranged with one end pivotally secured to a stationary frame member and the other end pivotally secured to a central portion of the indexing bar.

When the carriage is in its dressing position, the telescopic cylinder is fully retracted and only an end portion of the indexing bar extends through the guide space. During movement of the carriage from its dressing position towards its pressing position, the cylinder is extended and the indexing bar pivots and axially slides through the guide space. When the indexing bar is substantially vertical, the indexing bar has axially slid through the guide space a maximum predetermined distance. Further extension of the cylinder causes the indexing bar to axially slide in the opposite direction. When the carriage reaches its pressing position, only a small end portion of the indexing bar extends through the guide space. The length of the indexing bar, between its connection to the carriage and the point of connection of the cylinder thereto, limits the required length of the cylinder needed in order to accomplish the desired travel distance of the carriage between its dressing and pressing positions.

DESCRIPTION OF THE PREFERRED EMBODIMENT

Figure 1:
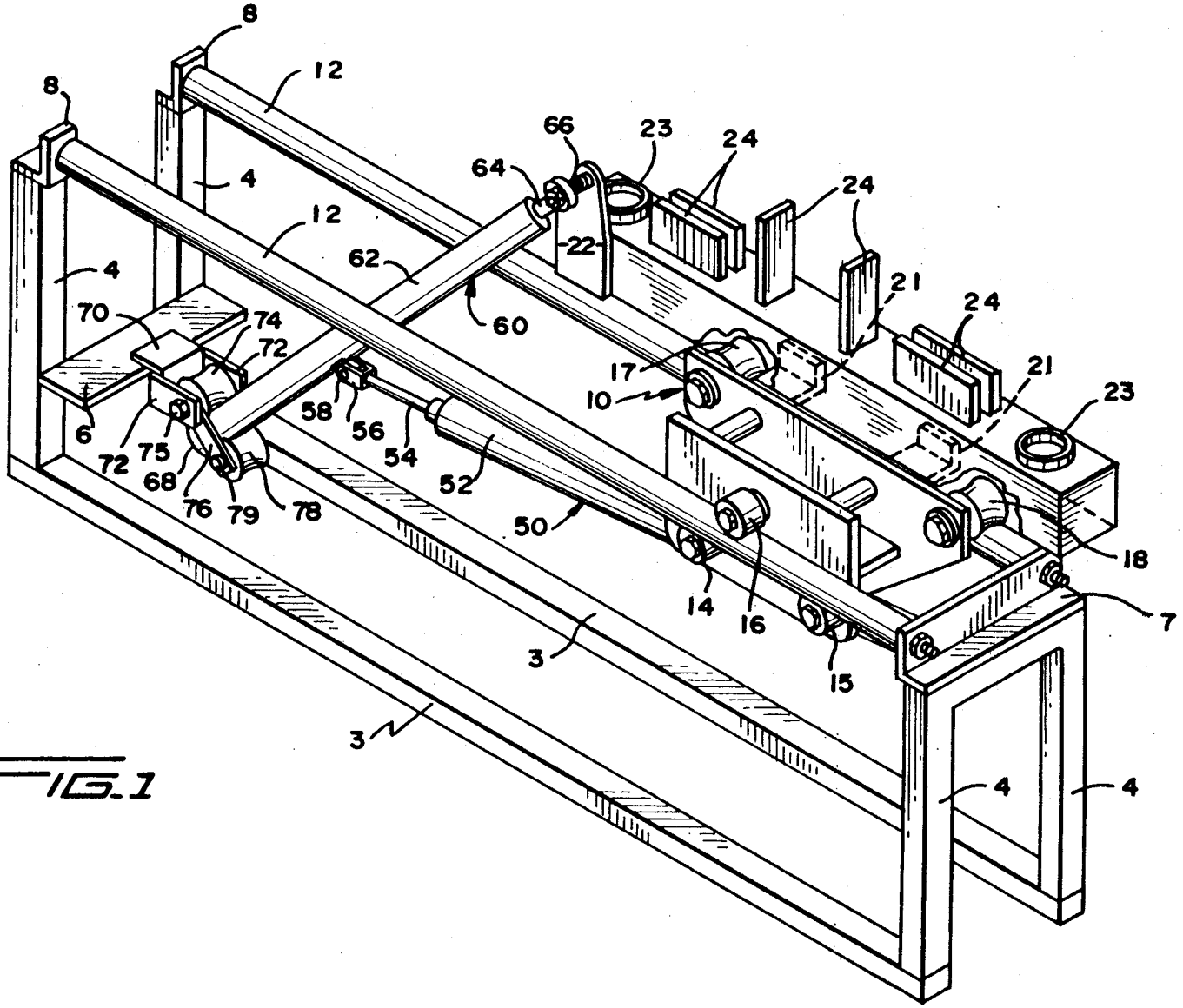
FIG. 1 is a perspective view of the indexing mechanism according to the present invention.
Figure 2:
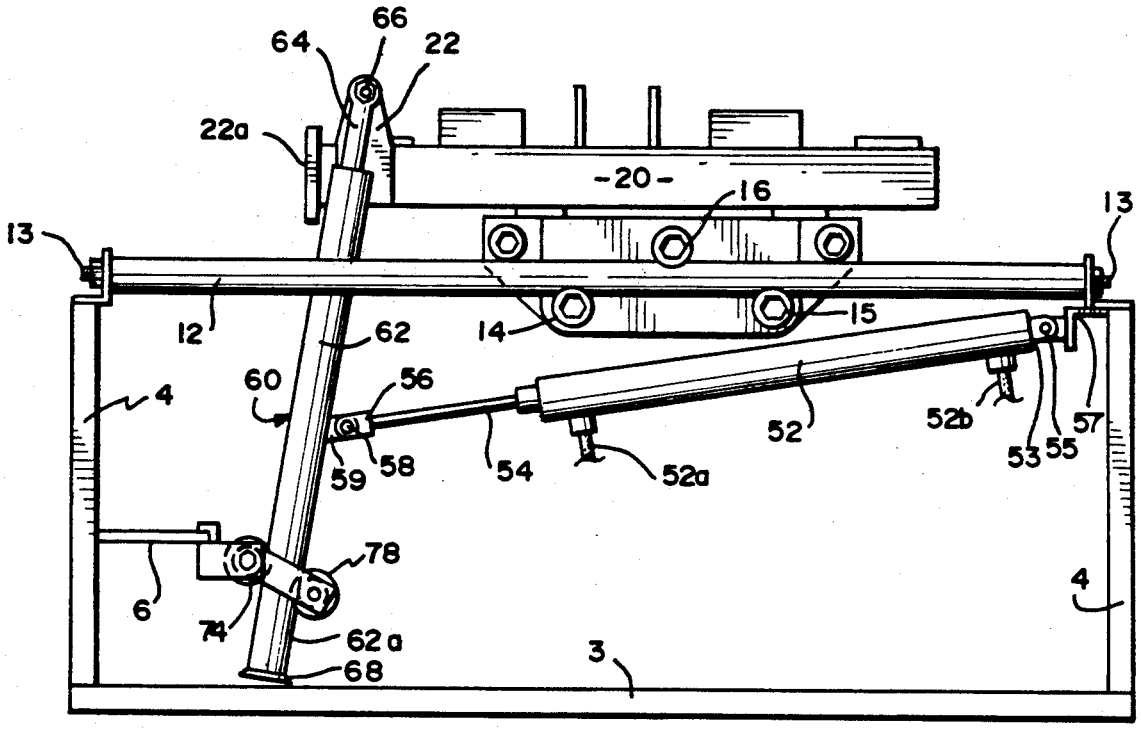
FIGS. 2 through 4 show perspective views of the indexing mechanism throughout its range of travel.

In accordance with the preferred embodiment, the indexing mechanism of the present invention is used in a laundry press system. As represented in FIG. 1, the system includes a stationary frame structure including base members 3, two pairs of upstanding end legs 4, and a cross brace 6 mounted between a pair of the upstanding end legs 4. Mounted between the upstanding end legs 4, by means of L-shaped brackets 7, 8 and bolts 13, is a pair of guide rails 12. As best seen in FIGS. 1 and 2, the guide rails 12 are mounted substantially parallel to one another in a spaced relationship.

Mounted upon the guide rails 12 is a support plate assembly 10 and buck or mannequin supporting carriage 20. The pressing buck or mannequin is not illustrated for clarity, but normally is carried above the carriage 20. The support plate assembly 10 carries various rollers 14–18 which support and guide the support plate assembly 10 and carriage 20 along guide rails 12. Rollers 14–16 bear against one guide rail 12 with rollers 14 and 15 bearing against a lower surface portion of the guide rail 12 in a longitudinally spaced relationship. Roller 16 bears against an upper surface portion of the same guide rail 12. Roller 16 is mounted to the support plate assembly 10 intermediate the mounting positions of rollers 14 and 15 in the longitudinal direction. Rollers 17 and 18 bear against an upper surface portion of the other guide rail 12. These rollers are also longitudinally spaced in a similar manner to that of rollers 14 and 15.

Guide rails 12 are shown to be cylindrical in shape. Rollers 17 and 18, as best shown in FIGS. 1 and 2, have concave bearing surfaces which aid not only in supporting the support plate assembly 10 and the carriage 20 on one of the guide rails 12 for longitudinal movement along the guide rail, but also support the support plate assembly 10 and carriage 20 on the guide rail 12 laterally.

Carriage 20 is secured to support plate assembly 10 by means of carriage mounting braces 21 as best shown in FIG. 1. Carriage 20 includes an opening 22*a* at the forward end thereof which is in fluid communication with openings 23 located in the top surface of carriage 20. The function of these openings will be explained more fully below. Various plates 24 shown fixed to an upper surface of the carriage 20 may be used for attachment of a buck or mannequin (not illustrated).

As best shown in FIGS. 1–4, fixedly secured to cross brace 6 is a mounting bracket 70 which has a pair of spaced leg members 72. The leg members 72 have aligned holes therein (not visible). Mounted in these holes, between the spaced leg members 72, is a first shaft 75 which defines a first pivot axis. Rotatably mounted about the first pivot axis is a first roller 74. Pivotally mounted on either side of the first roller 74 is a pair of link members 76 (only one being shown). The other ends of the link members 76 include a pair of aligned holes through which a second shaft 79 extends. The second shaft 79 defines a second pivot axis. Mounted between the link members 76 and rotatable about the second pivot axis is a second roller 78. Therefore it can be seen that, by use of link members 76, a guide space is defined between the rollers 74 and 78. Furthermore, the link members 76 permit roller 78 to pivot about the first pivot axis defined by first shaft 75.

Fixedly secured to a front portion of the carriage 20 is an upstanding attachment plate 22. An indexing bar 60 includes a main body portion 62 and a variable length connection portion 64. The connection portion 64 is pivotally mounted to the upstanding attachment plate 22 by means of a pivot connection and bolt 66. The main body portion 62 of indexing bar 60 includes a distal end portion 62*a* which extends through the guide space defined between rollers 74 and 78.

In the preferred embodiment, the main body portion 62 of indexing bar 60 is cylindrical in shape and the rollers 74 and 78 have concave bearing surfaces which accommodate the main body portion 62. The end 62*a* of main body portion 62 of indexing bar 60 is arranged to pivot and axially slide in the guide space between rollers 74 and 78. The distal end of main body portion 62 includes a stop member 68 in the form of an enlarged head which limits the amount of permissible sliding movement of the indexing bar 60 between rollers 74 and 78 in one direction. Basically, the stop member 68 prevents the indexing bar 60 from coming out of the guide space.

Figure 3:
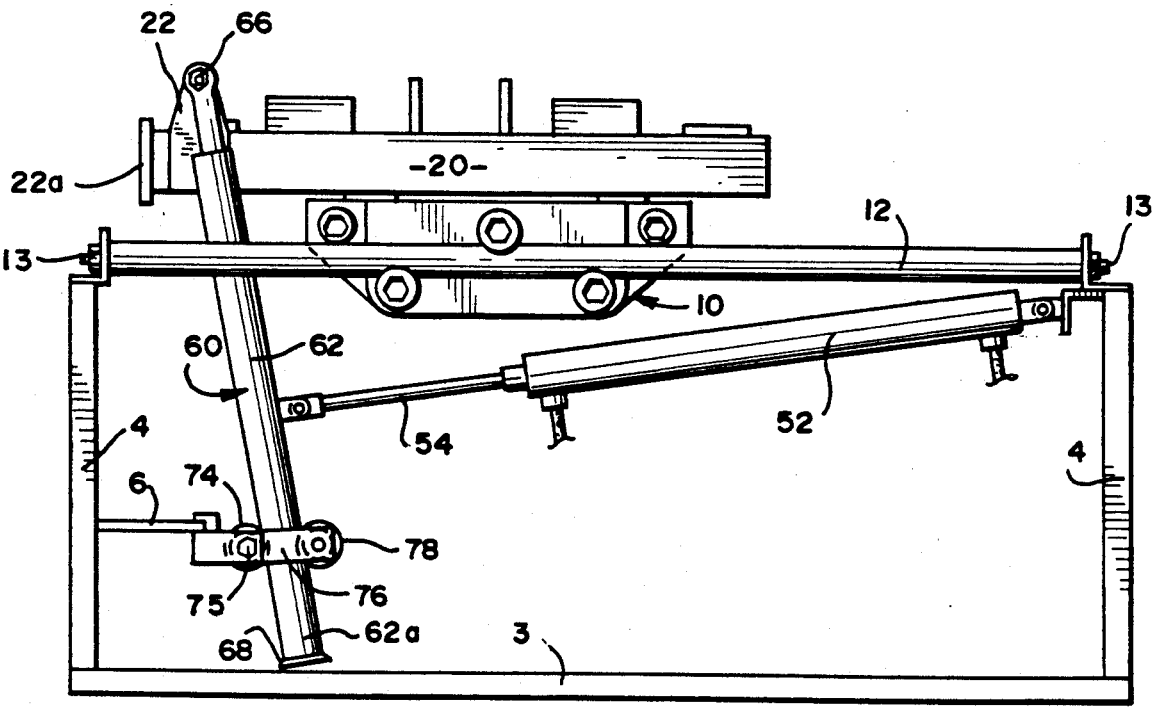
Figure 4:
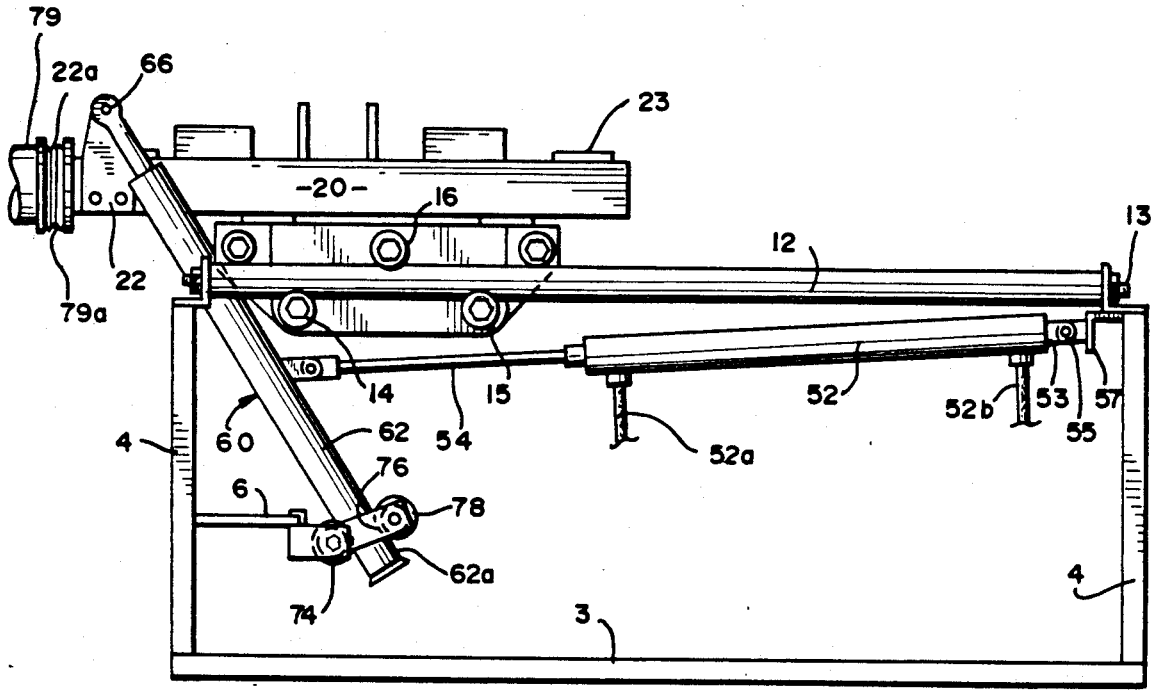

Pivotally secured between one pair of the upstanding end legs 4 of the frame structure and a central portion of the indexing bar 60 is a telescoping fluid cylinder 50. As best seen in FIGS. 3–4, the fluid cylinder 50 includes a cylinder portion 52 and a rod portion 54 which telescopes into and out of one end of the cylinder portion 52. The end of the cylinder portion 52, remote from the rod portion 54, has attached thereto an end connector 53. Fixedly secured between a pair of upstanding end legs 4 is a connection bracket 57. End connector 53 is pivotally connected to connection bracket 57 by means of pivot pin 55.

Fixedly secured to a central portion of the indexing bar 60 is a tab 59. An end of rod portion 54 of fluid cylinder 50 includes a clevis connector 56. The clevis connector 56 is pivotally connected to the tab 59 through a pivot pin 58.

Although the internal structure of the telescoping fluid cylinder 50 is not specifically shown in the drawings, this structure is conventional. Generally, the end of the rod portion 54 located within cylinder portion 52 would have fixed thereto a piston (not shown). The piston would divide the cylinder portion 52 into fore and aft chambers. The rod portion 54 would be selectively extended or retracted depending upon the fluid pressures supplied to the respective fore and aft chambers through suitable lines 52*a* and 52*b*. An appropriate control system (not shown) would control actuating fluid to lines 52*a* and 52*b* to control actuation of cylinder 50. In the preferred embodiment, the fluid cylinder 50 comprises a pneumatic cylinder, however, a hydraulic cylinder could also be used.

Reference will now be made to FIGS. 1 and 3–4 which show the positioning of the indexing mechanism throughout the range of movement of the carriage from a dressing position to a pressing position. As represented in FIG. 1, the carriage 20 is in a dressing position. The fluid cylinder 50 is fully retracted and the indexing bar 60 barely extends into the guide space between rollers 74 and 78. At this point, the buck or mannequin mounted on carriage 20 would be dressed with the garment to be pressed.

As shown in FIG. 2, the indexing of the carriage towards the pressing position has begun. The fluid cylinder 50 has been partially extended which, due to its attachment to indexing bar 60, has caused indexing bar 60 to partially pivot and axially slide in the guide space between rollers 74 and 78. This extension of cylinder 50 also causes pivoting of roller 78 and links 76 about the first axis defined by first shaft 75 and movement of carriage 20 along rails 12.

It is to be noted that the carriage 20 moves linearly along the rails 12, so that the upper connection and bolt 66 moves linearly parallel to rail 12. Since the lower end of indexing bar 6 essentially is pivotally retained between rollers 74, 78 at its lower end, effectively the motion of rod portion 54 of cylinder 52 is amplified at the upper pivot connection 66 to cause longer travel of carriage 20 relative to the distance traveled by the rod portion 54 of actuator cylinder 52.

As seen in FIG. 4, a conduit 79 having an end opening 79*a* is provided adjacent the left end of the frame structure, so that, as carriage 20 approaches its leftward extremity of travel, opening 22*a* in the carriage 20 will abut opening 79*a* of conduit 79 to provide fluid communication between a source of fluid pressure (not shown) and the interior of the carriage 20. The fluid is then ported through openings 23 into the interior of the buck or mannequin to inflate same during the pressing operation, as is well known.

Further extension of fluid cylinder 50 causes indexing bar 60 to further slide into the guide space between rollers 74 and 78 as shown in FIG. 3. As shown in that figure, the indexing bar 60 has pivoted to an overcenter position and has caused roller 78 and legs 76 to pivot further upward. Support plate assembly 10 and carriage 20 have also moved farther along guide rails 12 upon rollers 14–18.

FIG. 4 shows the carriage 20 in its near pressing position with the fluid cylinder 50 having been extended slightly less than its fully extended position. Links 76 and roller 78 have pivoted further upward about the first axis defined by first shaft 75. The indexing bar 60 has only a small portion of its main body portion 62 extending through the guide space between rollers 74 and 78.

As conventionally known in the art, when the carriage 20 reaches its pressing position, the opening in the front of carriage 20 will be sealed against the fluid supply conduit 79. Heated air will then be supplied, through the fluid supply passage, into carriage 20 and will flow out of carriage 20 through openings 23 discussed earlier. This heated air is channeled into the buck or mannequin and blown against the inner surfaces of the garment to be pressed. This air supply arrangement is well known and not considered to be part of the inventive concept.

By use of the present indexing mechanism, a fluid cylinder with a relatively short stroke can be used in combination with the simple, inexpensive to manufacture, indexing bar and roller guide arrangement to move the carriage a longer distance between its dressing and pressing positions. As clearly shown in FIG. 1, if the fluid cylinder 50 were directly connected between the support frame and the carriage 20, the rod portion 54 of the fluid cylinder 50 would have to be located farther t the right in FIG. 1. This would require the connection of the fluid cylinder 50 to the frame to be moved rearward or to the right as shown in FIG. 1. Therefore, in order to extend the carriage 20 from its dressing position to its pressing position, a much longer fluid cylinder would be required. By the present arrangement, the fluid cylinder 50 may extend forward of the carriage 20, when the carriage 20 is in its dressing position due to the rearward angling of the indexing bar 60.

In moving the carriage 20 to a pressing position, shown in FIG. 4, the present indexing mechanism requires a shorter extension of the fluid cylinder. This is due to the length of the indexing bar 60 between its upper pivot connection 66 and the attachment pivot 58 of the piston rod 54 to bar 60.

Although disclosed with respect to a particular embodiment, it can be readily seen that various changes and/or modifications may be made without departing from the spirit or scope of the present invention. In particular, although a pair of cylindrical guide rails are disclosed, it should be readily understood that the carriage could be mounted on a support plate which is guided on or about a single guide rail of any polygon shape or otherwise. Further, although indexing bar 60 is disclosed as being cylindrical in shape, various other shapes could be utilized. It is intended, therefore, that the present invention be limited solely by the scope of the following claims:

What is claimed is:

1. An indexing mechanism for use in a garment dressing and pressing machine having a support frame, at least one substantially horizontal guide rail secured to said support frame and a carriage supported by said at least one guide rail for linear movement between dressing and pressing positions comprising:

an elongated indexing bar having a first end portion pivotally secured to said carriage for linear movement therewith, a second distal end portion extending away from the carriage, and a central portion between said end portions;

bar guiding means attached to said support frame, said bar guiding means arranged to support said first end portion of said indexing bar for pivotal movement about a pivot axis and sliding movement along the length of the indexing bar;

the distal end portion of said indexing bar supported by said bar guiding means;

a telescoping fluid cylinder having relatively moveable portions including first and second ends, one of said ends being pivotally secured to said support frame and the other end being pivotally secured to the central portion of said indexing bar such that linear extension and retraction of a moveable portion of said relatively movable portions of said telescoping fluid cylinder results in pivotal movement of said indexing bar about said pivot axis and linear movement of said first end of the bar with said carriage along said at least one guide rail, with the linear movement of said first end and carriage being greater than the linear movement of the moveable portion of said cylinder.

2. An indexing mechanism as claimed in claim 1, wherein said bar guiding means comprises spaced rollers mounted for pivotal movement together about said pivot axis, said distal end of said indexing bar extending between said rollers.

3. An indexing mechanism as claimed in claim 2 wherein said indexing bar is cylindrical and said rollers have concave bearing surfaces facing each other and arranged to receive the cylindrical bar in close fitting relationship.

4. An indexing mechanism as claimed in claim 3 wherein said distal end of said indexing bar includes a stop means for limiting the sliding movement of said indexing bar between said rollers in a direction towards said carriage.

5. An indexing mechanism for use in a garment dressing and pressing machine having a support frame, at least one substantially horizontal guide rail secured to said support frame and a carriage supported by said at least one guide rail for linear movement between dressing and pressing positions comprising:

an elongated indexing bar having a first end portion pivotally secured to said carriage for linear movement therewith, a second distal end portion extending away from the carriage, and a central portion between said end portions;

bar guiding means attached to said support frame, said bar guiding means arranged to support said first end portion of said indexing bar for pivotal movement about a pivot axis and sliding movement along the length of the indexing bar;

the distal end portion of said indexing bar supported by said bar guiding means;

a telescoping fluid cylinder having relatively moveable portions including first and second ends, on e of said ends being pivotally secured to said support frame and the other end being pivotally secured to the central portion of said indexing bar such that linear extension and retraction of a moveable portion of said relatively moveable portions of said telescoping fluid cylinder results in pivotal movement of said indexing bar about said pivot axis and linear movement of said fist end of the bar with said carriage along said at least one guide rail, with the linear movement of said first end and carriage being greater than the linear movement of the moveable portion of said cylinder; said bar guiding means comprising spaced rollers mounted for pivotal movement together about said pivot axis; said distal end of said indexing bar extending between said rollers.

6. An indexing mechanism as claimed in claim 5 wherein said indexing bar is cylindrical and said rollers have concave bearing surfaces facing each other and arranged to receive the cylindrical bar in close fitting relationship.

7. An indexing mechanism as claimed in claim 5 wherein said distal end of said indexing bar includes a stop means for limiting the sliding movement of said indexing bar between said rollers in a direction towards said carriage.

* * * * *